US005105955A

United States Patent [19]

Hawryszkow et al.

[11] Patent Number: 5,105,955

[45] Date of Patent: Apr. 21, 1992

[54] SPHERICAL CONNECTOR APPARATUS IN AN ARTICULATED SLACKLESS-TYPE COUPLER ARRANGEMENT USED IN A RAILWAY APPLICATION

[75] Inventors: Michael G. Hawryszkow, Munster, Ind.; William D. Wallace, Chicago, Ill.; Edward G. Lynch, Jr., Saugus, Calif.; David W. Daugherty, Jr., Bolingbrook; Wajih Kanjo, Lockport, both of Ill.

[73] Assignees: Westinghouse Air Brake Company, Wilmerding, Pa.; Sargent Industries, Inc., Waukesha, Wis.

[21] Appl. No.: 520,581

[22] Filed: May 8, 1990

[51] Int. Cl.[5] ..... B61G 5/02

[52] U.S. Cl. ..... 213/75 R; 105/4.1; 213/62 R; 280/511; 403/113; 403/119

[58] Field of Search ..... 105/3, 4.1, 4.2; 213/12, 14, 62 R, 74, 75 R, 50, 188; 280/511; 180/134; 403/113, 117, 119, 154, 155, 316, 324

[56] References Cited

U.S. PATENT DOCUMENTS

| | | | |
|---|---|---|---|
| 1,986,149 | 1/1935 | Harris | 280/111 X |
| 2,998,268 | 8/1961 | Witter | 280/511 X |
| 4,258,628 | 3/1981 | Altherr | 105/4.1 |
| 4,305,676 | 12/1981 | Wallbank | 280/511 X |
| 4,336,758 | 6/1982 | Radwill | 105/4.1 |
| 4,531,648 | 7/1985 | Paton | 213/50 |
| 4,593,829 | 6/1986 | Altherr | 213/75 R |
| 4,867,071 | 9/1989 | Weber | 105/4.1 |

OTHER PUBLICATIONS

Maintenance Manual for ASF Articulated Connection Assembly.

*Primary Examiner*—Robert J. Oberleitner
*Assistant Examiner*—S. Joseph Morano
*Attorney, Agent, or Firm*—G. J. Falce

[57] ABSTRACT

Provided is an articulable spherical connection for a railway coupling arrangement. The connection includes a male connection member having a spherical connection portion secured to one end of a body portion and a female connection member having a split body portion. Each body portion of such femal connection member having a spherical cavity formed therein to receive a portion of the spherical connection portion of the male connection member therein. A securing device is provided to secure such split body portion together around the spherical connection portion of the male member.

43 Claims, 4 Drawing Sheets

SPHERICAL CONNECTOR APPARATUS IN AN ARTICULATED SLACKLESS-TYPE COUPLER ARRANGEMENT USED IN A RAILWAY APPLICATION

FIELD OF THE INVENTION

The present invention relates, in general, to a slackless-type coupler arrangement used to couple railway cars together and, more particularly, this invention relates to an improvement in such coupler arrangement for use in a railway application through the provision of an articulated spherical connector apparatus in a slackless-type coupler system.

BACKGROUND OF THE INVENTION

As is quite well known in the railway art, to which the present invention applies, railway cars are normally connected to one another by an arrangement consisting of coupler members to form a train consist. Such coupler members may be a conventional-type coupler which is backed by a draft gear assembly to control the slack between such railway cars during operation of the train consist. Or, as is the more recent case in the railway industry, such cars may be joined together by a slackless drawbar arrangement. In general, however, couplers used in this application have consisted of an independent unit that is secured to each end of a railway car in a position to allow interconnection with another independent unit of an adjacent car thereby forming the connection between the adjacent cars. On the other hand, the slackless drawbar arrangements in use are normally an integral-type coupling unit which extend between the ends of a pair of adjacent cars from the connection required between such pair of cars.

At the present time, regardless of the type of coupling arrangement being used, a shank end portion of the coupler member or slackless drawbar will be positioned in a manner such that it extends into the center sill portion of such railway car. In this position, the shank end portion is anchored so that during operation of the train consist the longitudinal forces generated by such operation will be transmitted to such railway car.

The present invention is primarily directed to an improvement in an articulated spherical connector apparatus which has application in a slackless-type drawbar coupling arrangement. In such a slackless coupling arrangement, as is well known in the railway car coupling art, the drawbar, or coupler, includes a portion that is positioned within the center sill portion of a car in a manner such that the longitudinal play or other undesirable movements associated with the coupling arrangement can be maintained at a minimum. However, because successive railway cars in a train consist normally must accommodate at least some amount of relative movement between such cars, particularly when both curved portions and inclined portions of the track must be negotiated during operation of such consist, there must be some provision in the coupling arrangement which allows each car to move in each of a pitch, a yaw and a roll mode which will be encountered with respect to such coupler arrangement. Additionally, it is obvious that, in any type coupling system which is used to form a connection between a pair of adjacent railway cars, there must be some provision made which permits such connected railway cars to be disconnected as required.

In a slackless-type coupling system, the coupler member is generally secured in such a manner that any undesirable longitudinal movement of such member in relationship to the car body portion will be either eliminated or at least substantially minimized. In the various coupling arrangements that have been taught in the prior art, this has been accomplished usually through the provision of a tapered wedge member that is located in the arrangement between a rear wall of the pocket casting and a follower block member which is positioned to rest against the butt end of the coupler member. Normally, the pocket casting in these prior-art-type coupling systems will be secured to the railway car in the center sill portion of such car. The wedge member provided tends to force the follower block away from the pocket casting end wall and into a substantially firm engagement with the butt end of the shank of the coupler member during operation of the train consist. For example, when such cars are being pushed by a locomotive, the longitudinal forces that are generated on this type coupling arrangement will cause a compression of the coupler member against the follower block, the wedge member and the end wall of the pocket casting to occur.

On the other hand, when such cars are being pulled by the locomotive, the longitudinal forces that are being generated on such coupling arrangement will exhibit a tendency to separate the drawbar member from the pocket casting. These forces are countered in these coupling arrangements by a draft key member. This draft key member is a metal bar which extends laterally of the center sill portion of the car through axially-opposed slots provided in the side walls of such center sill and through a slot provided in the shank portion of the coupler member. Normally, in a slackless-type coupling arrangement, the drawbar member is held tightly in position between the draft key bearing block and/or the draft key member and the follower block. This is usually accomplished by operation of the wedge member which separates the pocket casting and the follower block and compresses such follower block against the drawbar member. This compression of the follower block against the drawbar member forces the drawbar member against the draft key bearing block and/or the draft key member. Generally, however, the engageable mating faces of both the follower block and the drawbar member will include a curved surface which permits the drawbar member to pivot slightly over a limited range in both a vertical direction and a lateral direction. The curved surfaces of the mating faces also permit the car to roll with respect to the drawbar member during operation of the train consist. In addition, the drawbar member normally pivots at the draft key member or an arcuate draft key bearing block which is interposed between the components.

In the pocket casting of the slackless-type drawbar coupling arrangement in use at the present time in the railroad industry, the top, bottom and vertically disposed side walls provide a cavity for receiving therein the follower block member and the wedge member. In this coupling arrangement, the side walls of such pocket casting normally will limit the translation and, consequently, the rotation of the follower block member about the vertical axis of the arcuately-shaped butt end portion of the drawbar member in the event of a horizontal angling of the drawbar member occurring during operation. It is generally well recognized that such rotation of the follower block member can cause the wedge member to rotate in an undesirable manner about the longitudinal axis of the car body. This undesirable rotation can possibly result in such wedge member becoming hung up between the vertical side walls of the pocket casting thereby leading to substandard performance of the coupling arrangement. This can especially happen, for example, when the wedge member is relatively small in height in relation to its width. One of the most commonly used methods being used for controlling such rotation of the follower block member as well as the relative orientation between the wedge member and such follower block member is to provide an extremely close tolerance between such vertical side walls of the pocket casting and the wedge member and the side surfaces of such follower block member. As would generally be expected, however, because of the cast nature of a number of these component parts this particular procedure being used will normally require a rather large amount of uneconomical tolerance design and machining of finished component parts.

Furthermore, in more recent times, the railroad industry has discovered that the connection of a number of cars together to form a semi-permanent unit can be advantageous for a number of reasons. For example, railroad cars that are particularly adapted for "piggy-back" service have been connected together in such semi-permanent manner. These units are commonly known in the railroad industry as a "ten-pack." These semi-permanent units do not require the use of the standard coupling arrangement except between units since each semi-permanent unit needs to be only broken on occasion to permit maintenance of various individual components as necessary. Therefore, in this semi-permanent unit arrangement, one standard railway car truck may be used to support the end of two adjacent car bodies.

Generally, an articulating device will be used to combine railroad cars into these semi-permanent units. Such a device includes a male and a female connecting member which have ends that are attached respectively to adjacent ends of the railway car bodies forming such semi-permanent unit. A pin member is disposed in aligned apertures formed in the outer end of such member to form a joint therebetween. To allow for both vertical and horizontal movements that are required between male and female members during operation of the semi-permanent units, the pin aperture in the male member is somewhat larger than the pin member and includes a rear surface portion which provides a substantial contact area with such pin member. In order to maintain the pin aperture and the pin member in a desired controlled slack relationship, the male member is urged forward by a follower member which is carried within the female member and engages an end surface of the male member. In turn, the position of the follower member can be regulated, as required, by a wedge element which engages a pair of resilient components that are carried by the follower member in this articulated coupling arrangement.

Some examples of the prior art coupling arrangements that have been discussed briefly above are shown in U.S. Pat. Nos. 4,129,219; 4,258,628; 4,456,133; 4,593,827; 4,593,829 and 4,700,853.

SUMMARY OF THE INVENTION

The present invention provides an articulated substantially spherical connector apparatus. Such articulated spherical connector apparatus has been designed to be particularly useful in combination with an articulated-type coupling arrangement to be used in a railroad application to connect equipment together to form a train consist. The articulated connector apparatus includes both a male connector member and a female connector member. The male connector member includes a body portion. Such body portion has a predetermined size and shape as well as a predetermined length. Also, a substantially spherical end portion is secured to a first end of such body portion. Such substantially spherical end portion will have a radius that has been predetermined. In addition, a generally hollow extension member forms a portion of the male connector member. This extension member is secured to an axially opposed end of such body portion. Such extension member forms a cavity adjacent such second end of such body portion. The cavity thus formed has a cross-sectional size and shape that is predetermined. A pin member also forms a part of the male connector member. This pin member has a predetermined cross-sectional size and shape as well as a predetermined length. At least a portion of such cross-sectional size and shape of such pin member that is adjacent one end thereof will be somewhat smaller than such cross-sectional size and shape of such cavity formed in such extension member of the body portion. This enables easy insertion of such one end of such pin member into such cavity in the extension member. The final essential element required for the male connector member is a securing means which is engageable with each of such extension member and such pin member for securing such pin member to such extension member. The pin member is secured in the cavity of the extension member adjacent such one end of the pin member. The female connector member includes a first body portion which has a predetermined cross-sectional size and shape. The first body portion includes a first substantially spherical-shaped cavity formed therein adjacent one predetermined surface thereof. This first cavity receives therein a first predetermined portion of such spherical end portion of the male connector member. Further, this first spherical cavity has a contour that is substantially identical to the contour of such spherical end portion and a radius that is one of either substantially identical to or slightly larger than the radius of such spherical end portion. A second body portion is provided which also has a predetermined cross-sectional size and shape. This second body portion includes a second substantially spherical-shaped cavity that is formed therethrough. This second cavity receives therein a second predetermined portion of such spherical end portion of such male connector member. Like such first spherical-shaped cavity such second spherical-shaped cavity has a contour that is substantially identical to the contour of such spherical end portion and a radius which is at least one of either substantially identical to or slightly larger than such radius of the spherical end portion. Finally, the female connector member includes a means engageable with each of such first body portion and such second body portion for securing such second body portion to such first body portion with the spherical end portion of the male connector member within the cavities of such first body portion and such second body portion of the female connector member.

OBJECTS OF THE INVENTION

It is, therefore, one of the primary objects of the present invention to provide an articulated spherical connector apparatus for use in a slackless coupling arrangement in a railroad application which will overcome a number of the problems which have normally been encountered with the prior art railway car slackless coupling arrangement that are in service at the present time in the railroad industry.

Another object of the present invention is the provision of an articulated spherical connector apparatus for use in a slackless coupling arrangement to form semi-permanent railway units.

Still another object of the present invention is the provision of an articulated slackless coupling arrangement for a railway car that includes an improved articulated spherical connector portion which will substantially minimize the undesirable rotational problems which have normally been experienced with the articulated slackless coupling arrangements which are presently in service on existing railway cars.

Yet another object of the present invention is the provision of an articulated slackless coupling arrangement for a railway car in which a readily and easily replaceable self-lubricating liner system is incorporated into such arrangement to protect the exposed surfaces of the articulated spherical connector portion of the arrangement against excessive wear so that repair and maintenance costs associated with this type arrangement can be kept to a minimum.

A further object of the present invention is the provision of an articulated slackless coupling arrangement for use in a railway application which requires fewer component parts.

An additional object of the present invention is the provision of an articulated slackless coupling arrangement for use in a railway application which exhibits a reduction in weight thereby providing a savings in energy required.

Still yet another object of the present invention is the provision of an articulated slackless coupling arrangement for a railway car which permits the easy replacement of component parts as required.

Another object of the present invention is the provision of an articulated slackless coupling arrangement for use in a railway-type application which will substantially minimize the amount of relatively expensive machining that will normally be required on the various coupling components prior to the assembly of such components.

Still another object of the present invention is the provision of an articulated slackless coupling arrangement for a railway car which can be readily adapted for installation on the existing railway cars that are equipped for an articulated slackless coupling arrangement.

It is an additional object of the present invention to provide an articulated slackless coupling arrangement which can be used in conjunction with a specially equipped rail car truck portion to support the end of a trailer portion of a tractor trailer combination that is to be moved between destination points by rail.

In addition to the numerous objects and advantages of the present invention which have been described above, various other objects and advantages of an articulated slackless coupling arrangement equipped with an articulated spherical connector portion constructed according to the present invention will become more readily apparent to those persons who are skilled in the railroad industry articulated slackless coupling art from the more detailed description of the present invention which follows, particularly when such description is taken in conjunction with the attached drawings and with the appended claims.

BRIEF DESCRIPTION OF THE INVENTION

Figure 1:
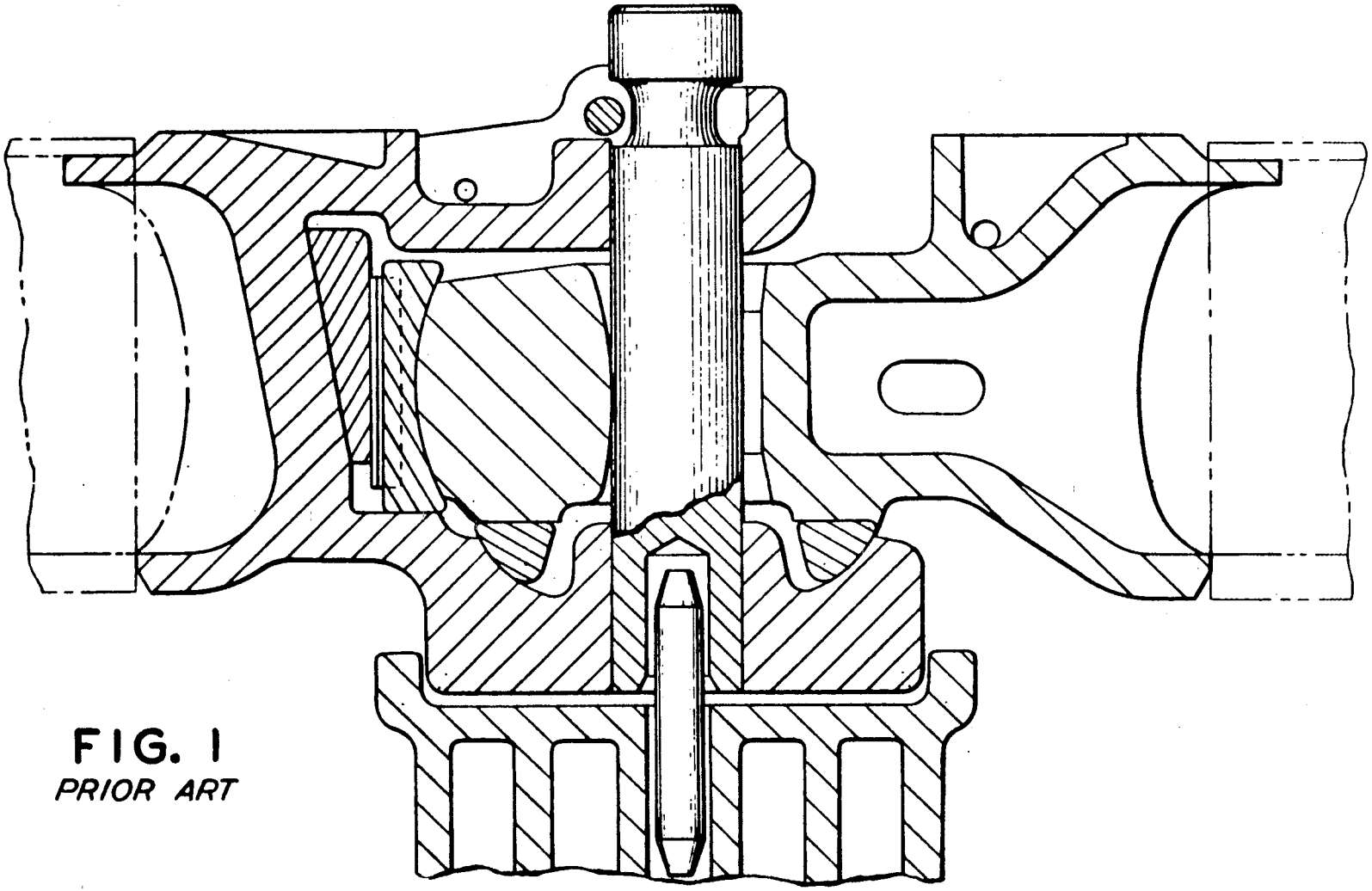
FIG. 1 PRIOR ART
FIG. 1 is a longitudinal cross-sectional view which illustrates a prior-art-type articulated slackless coupling arrangement for railway application.

Prior to proceeding to the more detailed description of the articulated spherical connector apparatus for an articulated slackless coupler arrangement, it should be noted that identical component parts have been identified with identical reference numerals throughout the several views which illustrate both the presently preferred and alternative embodiments of the invention.

In addition, in the following more detailed description of the present invention, it should be noted that as used in the specification and claims the following terms shall have the following meanings:

- Railway equipment includes rolling stock as well as truck maintenance equipment;
- Rolling stock includes both freight and passenger cars and locomotives;
- Freight cars include trucks equipped to operate on a track;
- Passenger cars include mass transit vehicles; and
- Trucks include each of light-duty, heavy-duty and tractor-trailer combinations.

Figure 2:
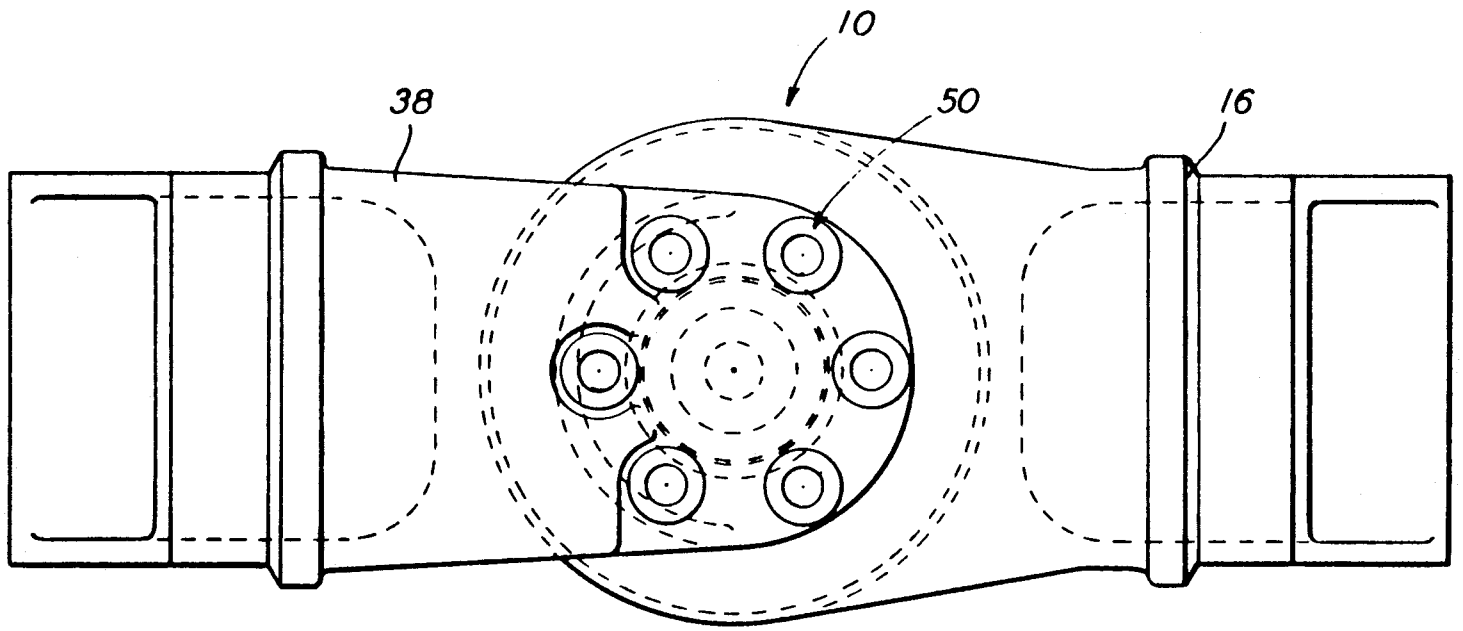
FIG. 2 is a plan view which illustrates one presently preferred embodiment of an articulated spherical connector device constructed according to the present invention for use in an articulated slackless coupling arrangement.
Figure 3:
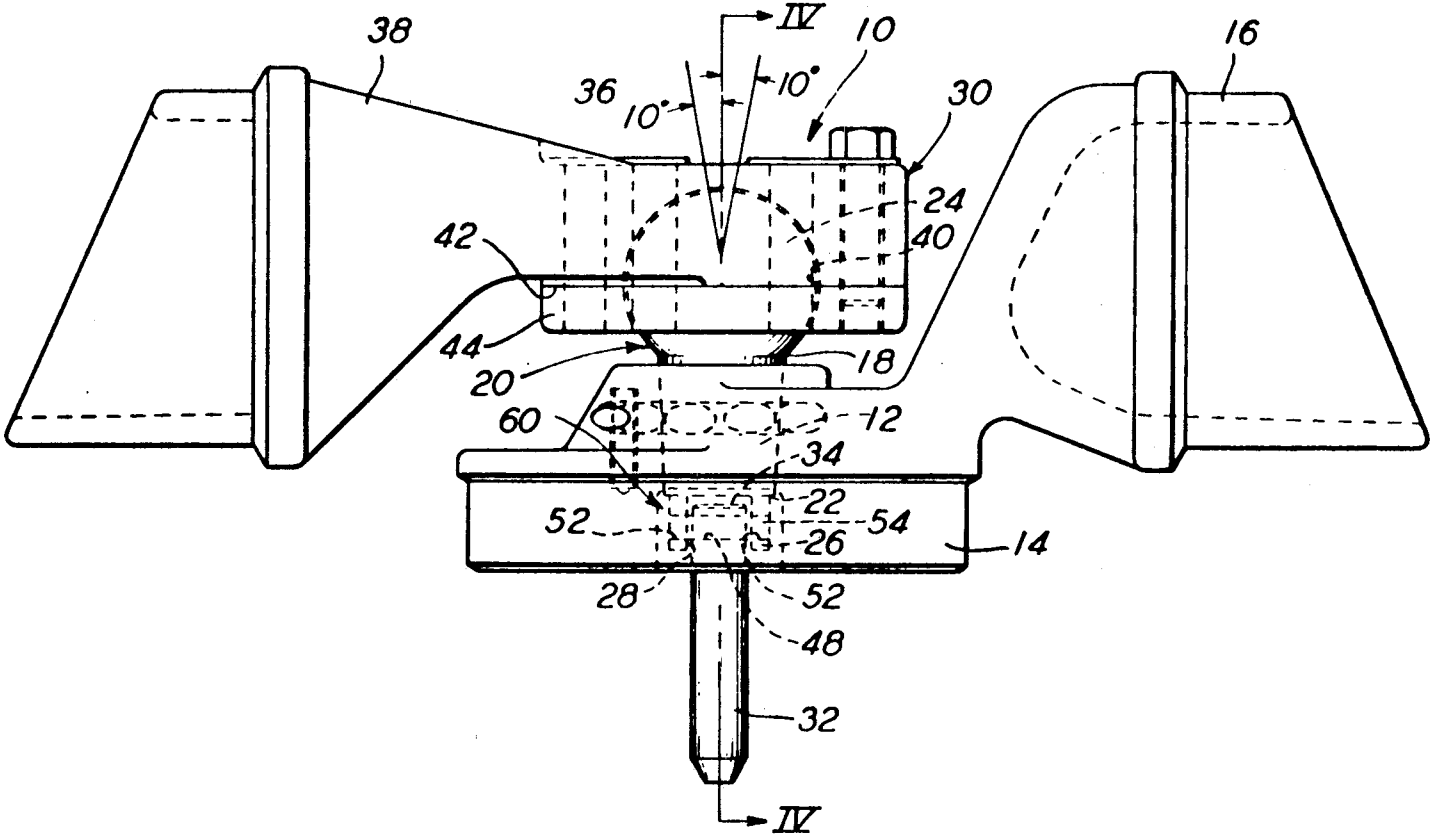
FIG. 3 is a side elevation view which illustrates the articulated spherical connector device shown in FIG. 1.
Figure 4:
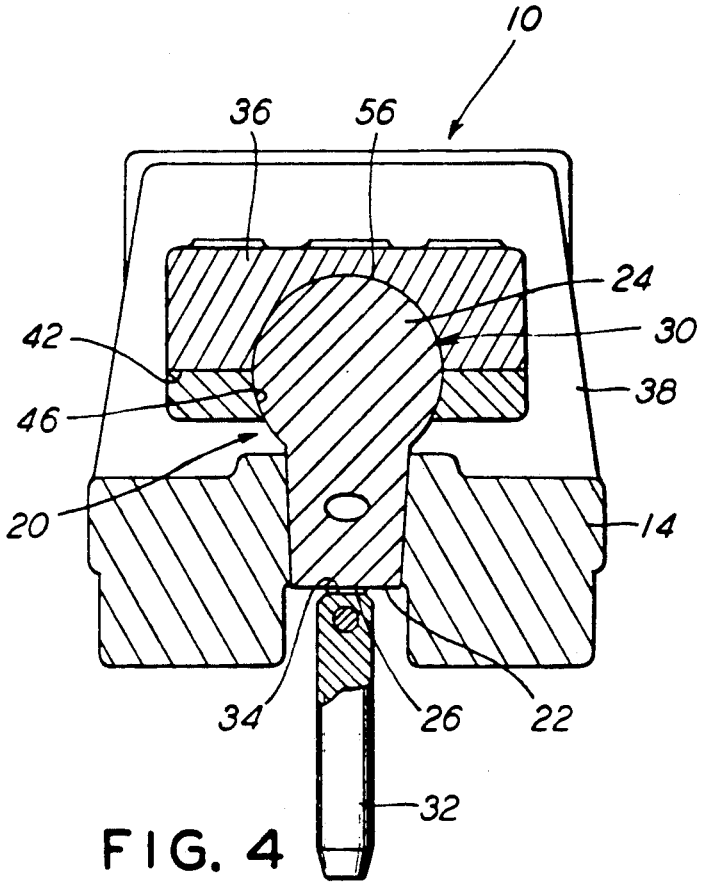
FIG. 4 is a cross-sectional view taken along lines IV—IV of FIG. 3 which illustrates one presently preferred embodiment of a replaceable self-lubricated liner system for use with such articulated spherical connector device illustrated in FIGS. and 3.

Now refer more particularly to FIGS. 2 through 4 for an understanding of one presently preferred embodiment of the invention. There is illustrated in FIGS. 2 through 4 an articulable substantially spherical connection apparatus, generally designated 10. Such spherical connection apparatus 10 is configured for use in combination with a coupling arrangement utilized in a railway-type application which enables movement of a train consist around both curved portions of a track (not shown), for the sake of clarity, and over a hilly terrain. In the present invention, the coupling arrangement is the type known in the art as an articulated slackless-type coupler. The articulable substantially spherical connection apparatus 10 includes both a male connection member, generally designated 20, and a female connection member, generally designated 30. The male connection member 20 is positionable intermediate the adjacent ends of a pair of car bodies (not shown), for the sake of clarity. Such car bodies are equipped to at least operate on such track. The female connection member 30 is engageable with the male connection member 20 and is, therefore, likewise positioned intermediate such adjacent ends of such pair of car bodies.

In this embodiment of the invention, the male connection member 20 includes a first body portion 12 which engages a member 14 that rests in the bolster bowl (not shown), for the sake of clarity, of a railway truck member (not shown), for the sake of clarity. The member 14 forms a portion of another member 16 which is secured to one end of such pair of car bodies. The first body portion 12, of the male connection member 20, has a first predetermined cross-sectional size, a first predetermined cross-sectional shape and a first predetermined length. The first body portion 12 includes a first end 18 and an axially opposed second end 22. Secured to such first end 18 of the first body portion 12 is a substantially spherical connection portion 24. This spherical connection portion 24 has a first predetermined radius. In addition, this spherical connection portion 24 is a solid member. The male connection member 20 further includes a generally hollow extension member 26 that is secured to such axially opposed second end 22 of the first body portion 12. The generally hollow extension member 26 may be, for example, either an enclosed wall portion or a pair of leg members secured to such axially opposed second end 22 of the first body portion 12. In either case, the generally hollow extension member 26 will extend from the axially opposed second end 22 of the first body portion 12 for a second predetermined length. In addition, the generally hollow extension member 26 will form a cavity 28 adjacent such axially opposed second end 22 of the first body portion 12. In the case where such generally hollow extension member 26 is an enclosed wall portion, the cavity will be defined by the perimeter of such wall portion and in the case where such generally hollow extension member 26 is a pair of leg members such cavity 28 will be defined as being the area between the inner surfaces of such pair of leg members. In any event, such cavity 28 has a second predetermined cross-section size and a second predetermined cross-sectional shape. The second predetermined cross-sectional shape of the cavity 28 formed in the extension member 26 is preferably generally round. Also included as a part of the male connection member 20 is a pin member 32. Such pin member 32 is engageable adjacent one end 34 thereof with such generally hollow extension member 26. The pin member 32 has a third predetermined cross-sectional size and a third predetermined cross-sectional shape as well as a third predetermined length. In addition, at least a predetermined portion of such third predetermined cross-sectional size and the third predetermined cross-sectional shape of the pin member 32 which is located adjacent such one end 34 thereof must be somewhat smaller than such second predetermined cross-sectional size and the second predetermined cross-sectional shape of such cavity 28 formed in the generally hollow extension member 26. This is to enable insertion of such one end 34 of the pin member 32 into the cavity 28 formed in such generally hollow extension member 26.

The female connection member 30 which engages the male connection member 20 includes a second body portion 36 which forms a part of a member 38 that is secured to one end of an adjacent one of such pair of car bodies. The second body portion 36 has a fourth predetermined cross-sectional size and a fourth predetermined cross-sectional shape. Further, the second body portion 36 has a first substantially spherical cavity 40 formed therein. Such first substantially spherical cavity is adjacent a predetermined surface 42 of the second body portion 36. A first predetermined portion of such substantially spherical connection portion 24 of such male connection member 20 is positioned within the first substantially spherical cavity 40 of such second body portion 36 of the female connection member 30. Such first substantially spherical cavity 40 has a contour that is substantially identical to the contour of such substantially spherical connection portion 24 of the male connection member 20. In addition, the first substantially spherical cavity 40 has a second predetermined radius that is at least one of either substantially identical to or slightly larger than such first predetermined radius of such substantially spherical connection portion 24 of the male connection member 20. The female connection member 30 also includes a third body portion 44. This third body portion 44 has a fifth predetermined cross-sectional size and a fifth predetermined cross-sectional shape and a second substantially spherical cavity 46 formed therethrough. Such second spherical cavity 46 receives therein a second predetermined portion of such spherical connection portion 24 of such male connection member 20. The first predetermined portion and the second predetermined portion of the spherical connection portion 24 positioned within the first spherical cavity 40 and the second spherical cavity 46 are substantially greater than fifty percent of the surface area of such spherical connection portion 24 but also less than one-hundred percent of such surface area of such spherical connection portion 24. A surface area to permit at least a ten-degree movement in two directions in a substantially vertical direction is not positioned within such first spherical cavity 40 and the second spherical cavity 46. Like the first spherical cavity 40, such second spherical cavity 46 has a contour that is substantially identical to the contour of such spherical connection portion 24 of the male connection member 20. Also, the second spherical cavity 46 has a third predetermined radius that is at least one of substantially identical to and slightly larger than the first predetermined radius of such substantially spherical connection portion 24 of such male connection member 20. A first securing means, generally designated 50, is provided. Such first securing means 50 is engageable with each of such second body portion 36 and the third body portion 44 and secures in a removable manner such third body portion 44 to such second body portion 36 thereby forming the female connection member 30 and such articulable substantially spherical connection apparatus 10. This first securing means 50 is preferably a plurality of bolts 58.

In the embodiment of the invention illustrated in FIGS. 2 through 4, the male connection member 20, of the articulable substantially spherical connection member 10, further includes a second securing means, generally designated 60. Such second securing means 60 is engageable with each of the generally hollow extension member 26 and such one end 34 of the pin member 32. The second securing means 60 preferably secures the pin member 32 to the generally hollow extension member 26 in a removable manner. Second securing means 60 comprises an aperture 48 formed through such one end 34 of the pin member 32. A pair of axially aligned apertures 52 are formed through a side wall, or leg members, of the generally hollow extension member 26. A rod-like member 54 is inserted through and engageable with each of the aperture 48 in such one end 34 of the pin member 32 and the pair of axially opposed apertures 52 located in the side wall of such generally hollow extension member 26. In this manner, the pin member 32 is pivotably connected to such generally hollow extension member 26. Although such rod-like member 54 can be a bolt or rivet, for example, it is preferably a rod that is dimensioned to be press-fitted into each of aperture 48 in such one end 34 of the pin member 34 and such pair of axially opposed apertures 52 that are located in such side wall of the generally hollow extension member 26.

In the presently preferred embodiment of the invention, as illustrated in FIGS. 2 through 4, at least the first body portion 12 and the spherical connection portion 24 and the generally hollow extension member 26 of the male connection member 20 are formed integrally as a single piece casting. Preferably, this single piece casting will be forged. Although it is within the broadest scope of this invention to cast the pair of axially opposed apertures 52 in the side wall of the generally hollow extension member 26, it is preferred that such pair of axially opposed apertures 52 be formed by drilling because of the difficulty that would be encountered in obtaining the close size tolerance that is required. Likewise, it is preferred that the aperture 48 formed in such one end 34 of the pin member 32 is formed therein by drilling.

According to the presently most preferred embodiment of the invention, each of the second predetermined radius of the first spherical cavity 40 formed in the second body portion 36 and the third predetermined radius of the second spherical cavity 46 formed in the third body portion 44, of the female connection member 30, are slightly larger than the first predetermined radius of such spherical connection portion 24, of the male connection member 20. In this manner, an annular space is formed between such spherical connection portion 24 of the male connection member 20 and the first spherical cavity 40 formed in the second body portion 36 and the second spherical cavity 46 formed in the third body portion 44 of such female connection member 30. Disposed in such annular space thus formed is a self-lubricating liner member 56. It is preferred that the second predetermined radius of the first spherical cavity 40 in the second body portion 36 be substantially identical to such third predetermined radius of such second spherical cavity 46 in the third body portion 44 of such female connection member 30.

The self-lubricating liner member 56, in a presently preferred embodiment of the invention, is a replaceable liner member. In addition, it is presently preferred that such self-lubricating liner member 56 be formed from a polymeric-type material and in at least two pieces. Forming such self-lubricating liner member 56 in at least two pieces will facilitate the replacement of such self-lubricating liner member 56 as required due to wear.

In each embodiment of the present invention, it is preferred that the first predetermined cross-sectional shape of the first body portion 12 of the male connection member 20 be generally round. In addition, it is preferred that such first body portion 12 of such male connection member 20 be tapered in a substantially uniform manner along the first predetermined length thereof. A widest diameter of the first body portion 12 of such male connection member 20 is adjacent the first end of such first body portion 12 and a narrowest diameter of such first body portion 12 of such male connection member 20 is adjacent the axially opposed second end of such first body portion 12. Such widest diameter of such first body portion 12 will generally be in a range of between about 8.75 inches and about 9.25 inches.

In this invention, at least one of fifty percent or less than fifty percent of a surface area of such spherical connection portion 24 of the male connector member 20 will contact a surface area of at least one of such first spherical cavity 40 formed in the second body portion 36 of the female connection member 30 and such second spherical cavity 46 formed in the third body portion 44 of the female connection member 30. It is preferred that about fifty percent of such surface area of such spherical connection portion 24 of the male connection member 20 contacts the spherical cavity 40 formed in the second body portion 36 of the female connection member 30. In this manner, the male connection member 20 can pivot in any direction with respect to such female connection member 30 over a predetermined angle when such predetermined angle is measured from any plane which intersects such a diametric center point of such spherical connection portion 24 of the female connection member 30. This predetermined angle is preferably about ten degrees.

Figure 5:
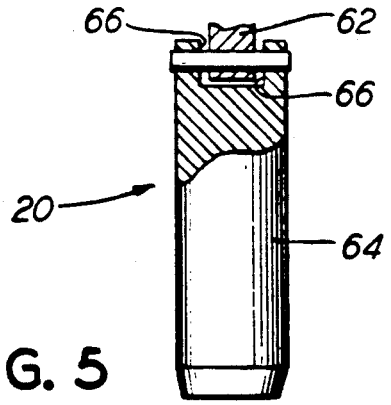
FIG. 5 is a fragmented cross-sectional view which illustrates an alternative embodiment of the connection between the extension member and the pin member for use with the articulated spherical connector device illustrated in FIGS. 2–4.

Now refer more particularly to FIG. 5, which illustrates an alternative embodiment of the male connection member of the articulable substantially spherical connection apparatus according to the present invention. In this embodiment of the invention, all of the elements are substantially identical except for the male connection member. Therefore, for the sake of brevity, a description of these elements will not be repeated here.

The male connection member, in this embodiment, is also positionable intermediate adjacent ends of a pair of car bodies (not shown) which are equipped to operate on such track. The male connection member includes a first body portion which has a first predetermined cross-sectional size and a first predetermined cross-sectional shape and a first predetermined length. Like the first body portion 12 of the male connection member 20 of the first embodiment of the invention described above, this first body portion has a first end and an axially disposed second end. Secured to such first end of the first body portion is a substantially spherical connection portion. Such substantially spherical connection portion has a first predetermined radius. Unlike the first embodiment of this invention, this embodiment includes a generally solid extension member 62 which is secured at a first end thereof to such axially opposed second end of such first body portion. This generally solid extension member 62 extends from such axially opposed second end of such first body portion for a second predetermined length. Such generally solid extension member 62 has a second predetermined cross-sectional size and a second predetermined cross-sectional shape. A pin member 64 is engaged with such generally solid extension member 62 adjacent one end of such pin member 64. Such pin member 64 has a cavity 66 formed therein adjacent such one end thereof to receive a portion of such solid extension member 62 therein. This cavity 66 has a third predetermined cross-sectional size and a third predetermined cross-sectional shape. At least a portion of the second predetermined cross-sectional size and such predetermined cross-sectional shape of such generally solid extension member 62 being smaller than such third predetermined cross-sectional size and such third cross-sectional shape of such cavity 66 formed adjacent such one end of such pin member 64 to enable insertion of the extension member 62 into the cavity 66. This pin member 64 has a third predetermined length.

Although the presently preferred and a number of alternative embodiments of the present invention have been described above, it should be obvious that various other modifications and adaptations can be made to the articulable substantially spherical connection apparatus of this invention without departing from the spirit and scope of the appended claims.

We claim:

1. An articulable substantially spherical connection apparatus, said apparatus is configured for use in combination with a coupling arrangement utilized in a railway-type application to enable movement of a train consist around curved portions of a track and over hilly terrain, said coupling arrangement being an articulated slackless-type coupler, said articulable substantially spherical connection apparatus comprising:

(a) a first connection member having a first end thereof engageable with one end of a first railway car body and a second end thereof engageable in a bolster bowl of a railway truck, said second end of said first connection member having an aperture formed therethrough;

(b) a vertically disposed male connection member positionable intermediate adjacent ends of a pair of car bodies which are equipped to at least operate on such track, said male connection member including;

(i) a first body portion having a first predetermined cross-sectional size and a first predetermined cross-sectional shape and a first predetermined length, said first body portion includes a first end and an axially opposed second end, a substantial portion of said first body portion being disposed in said aperture formed in said first connection member, (ii) a substantially spherical connection portion is secured to said first end of said first body portion, said substantially spherical connection portion having a first predetermined radius, (iii) a generally hollow extension member is secured to said axially opposed second end of said first body portion, said generally hollow extension member extends from said axially opposed second end of said first body portion for a second predetermined length, said generally hollow extension member forming a cavity adjacent said axially opposed second end of said first body portion, said cavity having a second predetermined cross-sectional size and a second predetermined cross-sectional shape, (iv) a pin member engageable adjacent one end thereof with said generally hollow extension member, said pin member having a third predetermined cross-sectional size and a third predetermined cross-sectional shape and a third predetermined length, at least a predetermined cross-sectional size and said third predetermined cross-sectional shape of said pin member adjacent said one end thereof being smaller than said second predetermined cross-sectional size and said second predetermined cross-sectional shape of said cavity formed in said generally hollow extension member to enable receiving said one end of said pin member within said cavity; and (v) a securing means engageable with each of said generally hollow extension member and said one end of said pin member for securing said pin member to said generally hollow extension member, said securing means including:

(a) an aperture formed through said one end of said pin member;

(b) a pair of axially opposed apertures formed through a side wall of said generally hollow extension member; and (c) a rod-like member inserted through and engageable with each of said aperture in said one end of said pin member and said pair of axially opposed apertures in said side wall of said generally hollow extension member; and (c) a female connection member engageable with said male connection member, said female connection member including;

(i) a second body portion having a fourth predetermined cross-sectional size and a fourth predetermined cross-sectional shape and a first substantially spherical cavity formed therein adjacent one predetermined surface thereof, a first predetermined portion of said substantially spherical connection portion of said male connection member is positioned within said first substantially spherical cavity, said first substantially spherical cavity having a contour substantially identical to a contour of said substantially spherical connection portion of said male connection member and a second predetermined radius that is at least one of substantially identical to and slightly larger than said first predetermined radius of said substantially spherical connection portion of said male connection member, (ii) a third body portion having a fifth predetermined cross-sectional size and a fifth predetermined cross-sectional shape and a second substantially spherical cavity formed therethrough for receiving therein a second predetermined portion of said substantially spherical connection portion of said male connection member, said second substantially spherical cavity having a contour that is substantially identical to said contour of said substantially spherical connection portion of said male connection member and a third predetermined radius that is at least one of substantially identical to and slightly larger than said first predetermined radius of said substantially spherical connection portion of said male connection member, and (iii) a first securing means engageable with each of said second body portion and said third body portion for securing said third body portion to said second body portion thereby forming said female connection member and said articulable substantially spherical connection apparatus.

2. An articulable substantially spherical connection apparatus, according to claim 1, wherein said rod-like member is press-fitted into said each of said aperture in said one end of said pin member and said pair of axially opposed apertures in said side wall of said generally hollow extension member.

3. An articulable substantially spherical connection apparatus, according to claim 2, wherein said first body portion and said substantially spherical connection portion and said generally hollow extension member of said male connection member are an integral single-piece casting and wherein said aperture in said pin member and said pair of axially opposed apertures in said side wall of said generally hollow extension member are formed by drilling.

4. An articulable substantially spherical connection apparatus, according to claim 2, wherein said second predetermined radius of said first substantially spherical cavity in said second body portion is substantially identical to said third predetermined radius of said second substantially spherical cavity in said third body portion of said female connection member and both said second predetermined radius and said third predetermined radius are slightly larger than said first predetermined radius of said substantially spherical connection portion of said male connection member and said apparatus further includes a self-lubricating liner member disposed in an annular space formed between said substantially spherical connection portion of said male connection member and each of said first substantially spherical cavity formed in said second body portion and said second substantially spherical cavity formed in said third body portion of said female connection member.

5. An articulable substantially spherical connection apparatus, according to claim 4, wherein said self-lubricating liner member is replaceable.

6. An articulable substantially spherical connection apparatus, according to claim 2, wherein one of fifty percent and less than fifty percent of a surface area of said substantially spherical connection portion of said male connection member contacts a surface area of at least one of said first substantially spherical cavity formed in said second body portion of said female connection member and said second substantially spherical cavity formed in said third body portion of said female connection member.

7. An articulable substantially spherical connection apparatus, according to claim 2, wherein said female connection member is relatively pivotal with respect to said male connection member over an angle of at least about ten degrees when said angle is measured from a diametric center point of said substantially spherical connection portion of said male connection member.

8. An articulable substantially spherical connection apparatus, according to claim 1, wherein said first body portion and said substantially spherical connection portion and said generally hollow extension member of said male connection member are an integral single one-piece casting.

9. An articulable substantially spherical connection apparatus, according to claim 1, wherein said second predetermined radius of said first substantially spherical cavity in said second body portion and said third predetermined radius of said second substantially spherical cavity in said third body portion are slightly larger than said first predetermined radius of said substantially spherical connection portion of said male connection member and said apparatus further includes a self-lubricating liner member disposed in an annular space formed between said substantially spherical connection portion of said male connection member and each of said first substantially spherical cavity formed in said second body portion and said second substantially spherical cavity formed in said third body portion of said female connection member.

10. An articulable substantially spherical connection apparatus, according to claim 9, wherein said second predetermined radius of said first substantially spherical cavity in said second body portion is substantially identical to said third predetermined radius of said second substantially spherical cavity in said third body portion of said female connection member.

11. An articulable substantially spherical connection apparatus, according to claim 9, wherein said self-lubricating liner member is replaceable.

12. An articulable substantially spherical connection apparatus, according to claim 11, wherein said self-lubricating liner member is a polymeric-type material.

13. An articulable substantially spherical connection apparatus, according to claim 12, wherein said self-lubricating liner member includes at least two pieces.

14. An articulable substantially spherical connection apparatus, according to claim 1, wherein said first securing means for securing said third body portion to said second body portion of said female connection member is a plurality of bolts.

15. An articulable substantially spherical connection apparatus, according to claim 1, wherein said first predetermined cross-sectional shape of said first body portion of said male connection member is generally round.

16. An articulable substantially spherical connection apparatus, according to claim 15, wherein said first body portion of said male connection member is tapered in a substantially uniform manner along said first predetermined length thereof, a widest diameter of said first body portion of said male connection member being adjacent said first end of said first body portion and a narrowest diameter of said first body portion of said male connection member being adjacent said axially opposed second end of said first body portion.

17. An articulable substantially spherical connection apparatus, according to claim 16, wherein said widest diameter of said first body portion of said male connection member is between about 8.75 inches and about 9.25 inches.

18. An articulable substantially spherical connection apparatus, according to claim 16, wherein said second predetermined cross-sectional shape of said cavity formed in said generally hollow extension member is generally round.

19. An articulable substantially spherical connection apparatus, according to claim 16, wherein one of fifty percent and less than fifty percent of a surface area of said substantially spherical connection portion of said male connection member contacts a surface area of at least one of said first substantially spherical cavity formed in said second body portion of said female connection member and said second substantially spherical cavity formed in said third body portion of said female connection member.

20. An articulable substantially spherical connection apparatus, according to claim 16, wherein said female connection member is relatively pivotal with respect to said male connection member over an angle of at least about ten degrees when said angle is measured from a diametric center point of said substantially spherical connection portion of said male connection member.

21. An articulable substantially spherical connection apparatus, according to claim 15, wherein said first predetermined cross-sectional shape of said first body portion of said male connection member is generally round.

22. An articulable substantially spherical connection apparatus, according to claim 21, wherein said first body portion of said male connection member is tapered in a substantially uniform manner along said first predetermined length thereof, a widest diameter of said first body portion of said male connection member being adjacent said first end of said first body portion and a narrowest diameter of said first body portion of said male connection member being adjacent said axially opposed second end of said first body portion.

23. An articulable substantially spherical connection apparatus, according to claim 22, wherein said widest diameter of said first body portion of said male connection member is between about 8.75 inches and about 9.25 inches.

24. An articulable substantially spherical connection apparatus, according to claim 22, wherein said third predetermined cross-sectional shape of said cavity formed adjacent said one end of said pin member is generally round.

25. An articulable substantially spherical connection apparatus, according to claim 1, wherein one of fifty percent and less than fifty percent of a surface area of said substantially spherical connection portion of said male connection member contacts a surface area of at least one of said first substantially spherical cavity formed in said second body portion of said female connection member and said second substantially spherical cavity formed in said third body portion of said female connection member.

26. An articulable substantially spherical connection apparatus, according to claim 25, wherein about fifty percent of said surface area of said substantially spherical connection portion of said male connection member contacts said first substantially spherical cavity formed in said second body portion of said female connection member.

27. An articulable substantially spherical connection apparatus, according to claim 25, wherein said female connection member is relatively pivotal with respect to said male connection member over an angle of at least about ten degrees when said angle is measured from a diametric center point of said substantially spherical connection portion of said male connection member.

28. An articulable substantially spherical connection apparatus, according to claim 1, wherein said female connection member is relatively pivotal with respect to said male connection member over a predetermined angle when said predetermined angle is measured from a diametric center point of said substantially spherical connection portion of said male connection member.

29. An articulable substantially spherical connection apparatus, according to claim 28, wherein said predetermined angle is at least about ten degrees.

30. An articulable substantially spherical connection apparatus, said apparatus is configured for use in combination with a coupling arrangement utilized in a railway-type application to enable movement of a train consist around curved portions of a track and over hilly terrain, said coupling arrangement being an articulated slackless-type coupler, said articulable substantially spherical connection apparatus comprising:

(a) a male connection member positionable intermediate adjacent ends of a pair of car bodies which are equipped to at least operate on such track, said male connection member including;

(i) a first body portion having a first predetermined cross-sectional size and a first predetermined cross-sectional shape and a first predetermined length, said first body portion includes a first end and an axially opposed second end, (ii) a substantially spherical connection portion is secured to said first end of said first body portion, said substantially spherical connection portion having a first predetermined radius, (iii) a generally solid extension member is secured at a first end thereof to said axially opposed second end of said first body portion, said generally solid extension member extends from said axially opposed second end of said first body portion for a second predetermined length, said generally solid extension member having a second predetermined cross-sectional size and a second predetermined cross-sectional shape, and (iv) a pin member engageable adjacent one end thereof with said generally solid extension member, said pin member having a cavity formed therein adjacent said one end thereof, said cavity having a third predetermined cross-sectional size and a third predetermined cross-sectional shape, at least a portion of said second predetermined cross-sectional size and said predetermined cross-sectional shape of said generally solid extension member being smaller than said third predetermined cross-sectional size and said third cross-sectional shape of said cavity formed adjacent said one end of said pin member to enable insertion of said generally solid extension member into said cavity formed adjacent said one end of said pin member, said pin member having a third predetermined length; and (b) a female connection member engageable with said male connection member, said female connection member including;

(i) a second body portion having a fourth predetermined cross-sectional size and a fourth predetermined cross-sectional shape and a first substantially spherical cavity formed therein adjacent one predetermined surface thereof, a first predetermined portion of said substantially spherical connection portion of said male connection member is positioned within said first substantially spherical cavity, said first substantially spherical cavity having a contour substantially identical to a contour of said substantially spherical connection portion of said male connection member and a second predetermined radius that is at least one of substantially identical to and slightly larger than said first predetermined radius of said substantially spherical connection portion of said male connection member, (ii) a third body portion having a fifth predetermined cross-sectional size and a fifth predetermined cross-sectional shape and a second substantially spherical cavity formed therethrough for receiving therein a second predetermined portion of said substantially spherical connection portion of said male connection member, said second substantially spherical cavity having a contour that is substantially identical to said contour of said substantially spherical connection portion of said male connection member and a third predetermined radius that is at least one of substantially identical to slightly larger than said first predetermined radius of said substantially spherical connection portion of said male connection member, and (iii) a first securing means engageable with each of said second body portion and said third body portion for securing said third body portion to said second body portion thereby forming said female connection member and said articulable substantially spherical connection apparatus.

31. An articulable substantially spherical connection apparatus, according to claim 30, wherein said male connection member further includes a second securing means engageable with each of said generally solid extension member and said one end of said pin member for securing said pin member to said generally solid extension member of said male connection member.

32. An articulable substantially spherical connection apparatus, according to claim 31, wherein said second securing member comprises:

(a) an aperture which is formed through said generally solid extension member;

(b) a pair of axially opposed apertures which are formed through a side wall of said cavity formed adjacent said one end of said pin member; and (c) a rod-like member inserted through and engageable with each of said aperture in said generally solid extension member and said pair of axially opposed apertures in said side wall of said cavity formed adjacent said one end of said pin member.

33. An articulable substantially spherical connection apparatus, according to claim 32, wherein said rod-like member is press-fitted into said each of said aperture in said generally solid extension member and said pair of axially opposed apertures in said side wall of said cavity formed adjacent said one end of said pin member.

34. An articulable substantially spherical connection apparatus, according to claim 30, wherein said first body portion and said substantially spherical connection portion and said generally solid extension member of said male connection member are formed integrally as a single one-piece casting.

35. An articulable substantially spherical connection apparatus, according to claim 30, wherein said second predetermined radius of said first substantially spherical cavity in said second body portion and said third predetermined radius of said second substantially spherical cavity in said third body portion are slightly larger than said first predetermined radius of said substantially spherical connection portion of said male connection member and said apparatus further includes a self-lubricating liner member disposed in an annular space formed between said substantially spherical connection portion of said male connection member and said first substantially spherical cavity formed in said second body portion and said second substantially spherical cavity formed in said third body portion of said female connection member.

36. An articulable substantially spherical connection apparatus, according to claim 35, wherein said second predetermined radius of said first substantially spherical cavity in said second body portion is substantially identical to said third predetermined radius of said second substantially spherical cavity in said third body portion of said female connection member.

37. An articulable substantially spherical connection apparatus, according to claim 35, wherein said self-lubricating liner member is replaceable.

38. An articulable substantially spherical connection apparatus, according to claim 37, wherein said self-lubricating liner member is formed from a polymeric-type material.

39. An articulable substantially spherical connection apparatus, according to claim 38, wherein said self-lubricating liner member is formed in at least two pieces.

40. An articulable substantially spherical connection apparatus, according to claim 30, wherein one of fifty percent and less than fifty percent of a surface area of said substantially spherical connection portion of said male connection member contacts a surface area of at least one of said first substantially spherical cavity formed in said second body portion of said female connection member and said second substantially spherical cavity formed in said third body portion of said female connection member.

41. An articulable substantially spherical connection apparatus, according to claim 40, wherein said female connection member is relatively pivotal with respect to said female connection member over an angle of at least about ten degrees when said angle is measured from a diametric center point of said substantially spherical connection portion of said male connection member.

42. An articulable substantially spherical connection apparatus, according to claim 30, wherein said female connection member is relatively pivotal with respect to said male connection member over a predetermined angle when said predetermined angle is measured from a diametric center point of said substantially spherical connection portion of said male connection member.

43. An articulable substantially spherical connection apparatus, according to claim 42, wherein said predetermined angle is at least about ten degrees.

* * * * *

UNITED STATES PATENT AND TRADEMARK OFFICE

CERTIFICATE OF CORRECTION

PATENT NO. : 5,105,955

DATED : April 21, 1992

INVENTOR(S) : Michael G. Haeryszkow et al

It is certified that error appears in the above-indentified patent and that said Letters Patent is hereby corrected as shown below:

Column 6, line 20, after FIGs, insert --2--.

Signed and Sealed this

Fourth Day of January, 1994

Bruce Lehman

*Attest:*

BRUCE LEHMAN

*Attesting Officer*

*Commissioner of Patents and Trademarks*